United States Patent [19]

Kaneko

[11] Patent Number: 5,036,807

[45] Date of Patent: Aug. 6, 1991

[54] VARIABLE VALVE TIMING LIFT DEVICE

[75] Inventor: Shinichiro Kaneko, Chigasaki, Japan

[73] Assignee: Isuzu Motors Limited, Tokyo, Japan

[21] Appl. No.: 541,893

[22] Filed: Jun. 22, 1990

[30] Foreign Application Priority Data

Jun. 30, 1989 [JP] Japan ..... 1-170803

[51] Int. Cl.[5] ..... F01L 1/34

[52] U.S. Cl. ..... 123/90.16; 123/315; 123/432; 123/90.33

[58] Field of Search ..... 123/90.12, 90.15, 90.16, 123/90.17, 90.22, 90.23, 308, 315, 432, 90.33

[56] References Cited

U.S. PATENT DOCUMENTS

| | | | |
|---|---|---|---|
| 4,674,451 | 6/1987 | Rembold et al. | 123/90.16 |
| 4,726,332 | 2/1988 | Nishimura et al. | 123/90.16 |
| 4,858,574 | 8/1989 | Fukuo et al. | 123/90.16 |
| 4,919,089 | 4/1990 | Fujiyoshi et al. | 123/90.16 |

*Primary Examiner*—E. Rollins Cross
*Assistant Examiner*—Weilun Lo
*Attorney, Agent, or Firm*—Jones, Tullar & Cooper

[57] ABSTRACT

A variable valve timing and lift mechanism consists of low and high speed cams provided in phase on the camshaft of an overhead camshaft engine, the high speed cam having larger lift than the low speed cam although the base circle diameter of the two is the same. The low speed cam is coupled to port opening/closing valve(s) via a direct-driven tappet and the high speed cam is coupled to the same valve via a piston-type tappet consisting of a pair of pistons sealed in a support with an oil chamber interposed in between. The oil chamber is connected to the lubricating oil circuit of the engine by an oil passage provided with a control valve. This variable valve timing and lift device with the so-called direct attack-type dynamic valve mechanism, where the cam drives the valves directly without using any rocker arm and connecting mechanism, solves the problems created by the inability of the rocker arm, etc. to keep pace with the valve at high speed because of inadequate rigidity of the dynamic valve system; it yields high output at both low and high speeds; it does not suffer from lift loss; it can correctly select valve timing and valve lift in conformity with the high or low speed of the engine; and it has small valve acceleration.

2 Claims, 2 Drawing Sheets

VARIABLE VALVE TIMING LIFT DEVICE

BACKGROUND OF THE INVENTION

1. Technical Field of the Invention

This invention relates mainly to a variable valve timing and lift device for automotive engines.

2. Prior Art

At present there are certain variable valve timing and lift devices for automotive engines in public knowledge, for example, those under the unexamined Japanese patents publications No. 55-500656, 61-250307, etc.

The devices mentioned in these publications consist of a multiple number of cams of different profiles and an equal number of rocker arms, and these are coupled to the intake valve or exhaust valve by a connecting mechanism. The connecting mechanism is switched from one cam to the other for varying the valve timing and lift according to the operational condition of the engine. Not only are these rocker arms and connecting mechanisms complicated in construction, their use for coupling the cams with the valves creates new problems because of the resulting drop in rigidity.

Said drop in rigidity is specially critical at high speed engine operation where high rigidity is required to meet high cam acceleration. Low rigidity way cause the valves to fail to keep pace with the cam profile, and the valves may jump and bounce. When this happens, the engine can no longer run at high speed. Thus the use of a variable valve timing and lift device for obtaining high output from low speed to high speed by making the valve timing and valve lift variable losses its meaning.

In order to overcome this difficulty, the unexamined Japanese patent publication No. 63-41611 has proposed an engine valve train where each valve is operated directly by a cam via a hydraulic lifter. In this construction, a low speed cam is fixed to the camshaft, and a high speed cam having cam profile larger than that of low speed cam is provided on the camshaft in such a way that it can move in the axial direction of the camshaft but cannot rotate relative to this shaft. A plunger that slides inside the camshaft under the action of hydraulic pressure in the oil passage provided in the camshaft and a return spring allow this high speed cam to come into contact and out of contact with the hydraulic lifter.

Since the rocker arms and connecting mechanisms stated earlier are not required in the construction mentioned in this publication, there is no danger of any chain reaction, such as a decrease in rigidity, leading to a problem for the valves to keep pace, and the consequent jumping and bouncing of the valves. However, since the hydraulic system provided for camshaft lubrication is also used here for moving the high speed cam, the hydraulic pressure originally meant for lubrication fluctuates, depending on whether the high speed cam is working or resting. This destabilizes the oil supply to the camshaft journal, posing the danger of seizure of the journal. Another problem here is that the camshaft construction becomes complicated, affecting rigidity, which in turn calls for enlarging the camshaft size to increase rigidity.

The unexamined Japanese patent publication No. 59-101515, on the other hand, proposes an internal combustion engine valve opening and closing device of the following construction. In this device where the cam fitted to the camshaft works to open and close the valve(s), a pair of pistons is provided in the mechanism that transmits force from the cam to the valve(s). In addition, tapered step or groove is provided in the piston that is nearer to the cam, and the two pistons are accommodated in an oil cylinder containing a relief hole to let out the oil.

The construction shown in this publication is simpler, and the fluctuation in the hydraulic pressure of the lubricating system is less, compared with the construction of the unexamined Japanese patent publication No. 63-41611. However, since the amount of lift is varied through the control of oil, which is always present between the pair of pistons, by relieving said oil as the tapered groove value (upper piston) turns while the valve is moved up and down by the cam, a lift loss occurs as the tapered groove (oil feed hole) opens and closes. The problem that results from this is that the actual valve lift in this case becomes smaller than the valve lift that the cam should normally produce.

On the other hand, the mechanism proposed in the unexamined Japanese patent publication No. 59-101515, employs in effect, the method of varying the amount of gap as the means for making the cam (valve) lift variable. Here, since a large gap is produced even at the time of maximum lift control, and also the lift is varied by rotating the piston (upper) and lengthening the relief time as stated above, the net amount of lift becomes small. Since the ramp on the cam profile that operates the valve mechanism in normal manner disappears at this time, the acceleration during the opening and closing of the valve becomes abnormally high, producing loud noise and occasionally bouncing of the valves. This is why it is very difficult to put the valve mechanism proposed in this publication into practical use in an internal combustion engine.

OBJECT OF THE INVENTION

In view of the problems involved in the devices discussed above, this invention aims at a variable valve timing and lifting mechanism that is capable of properly selecting the valve timing and valve lift for high or low engine speeds, and at the same time is structurally simple and will not produce any lift loss or any of the problems related to rigidity discussed above.

The construction of the variable valve timing and lift device proposed in this invention for achieving the above objective consists of low and high speed cams provided in phase on the camshaft of an overhead camshaft engine, the high speed cam having larger lift than the low speed cam although the base circle diameter of the two is the same. The low speed cam is coupled to the port opening/closing valve(s) via a direct-driven tappet, and the high speed cam is also coupled to the same valve via a piston-type tappet consisting of a pair of pistons sealed in a support with an oil chamber interposed in between. The oil chamber is connected to the lubricating oil circuit of the engine by an oil passage provided with a control valve.

DETAILED DESCRIPTION OF THE INVENTION

Figures 1, 2:
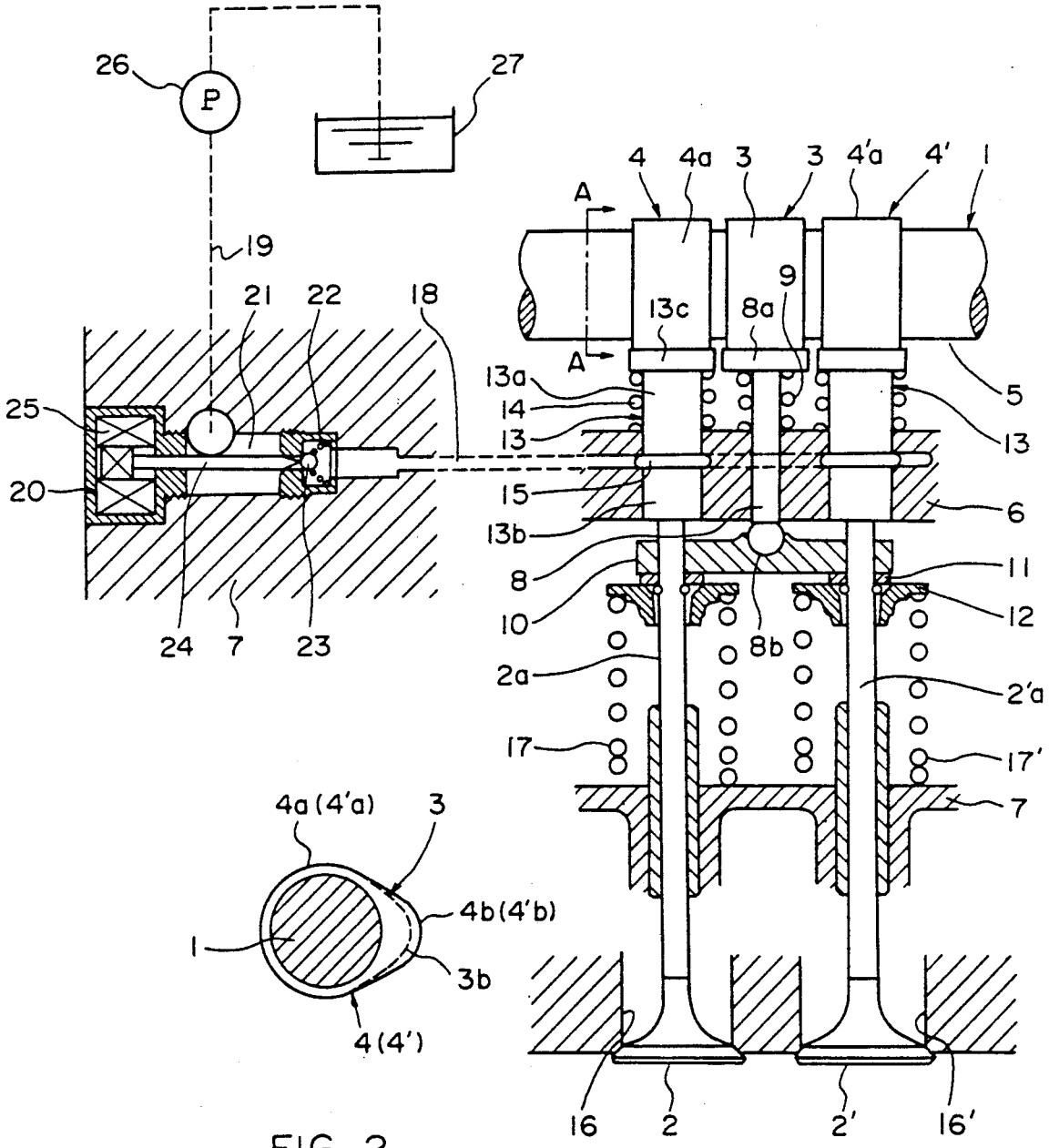
FIG. 1 shows a simplified vertical sectional diagram of the variable value timing and lift device proposed in this invention.
FIG. 2 shows the A—A sectional view of FIG. 1 as seen from the arrow direction.

The details of the variable valve timing and lift device will be described with reference to the accompanying drawings, to which reference is now made. A low speed cam 3 and two high speed cams 4, 4' located on opposite sides of cam 3 for operating the port opening/closing valves 2, 2', are supported on the camshaft 1 which in turn is supported on the cylinder head 7 by the journal 5 via the cam carrier 6, etc.

The low speed cam 3 and the two high speed cams 4, 4' are integral with the camshaft 1, and as shown in FIG. 2, the base circles 4*a*, 4'*a* of the high speed cams 4, 4' have the same diameter as the base circle 3*a* of the low speed cam 3. However, the lift, i.e., the nose 4*b*, 4'*b* of the two high speed cams 4, 4' is slightly higher than the nose 3*b* of the low speed cam 3. All these three noses operate in phase.

Supported by the cam carrier 6, the direct-driven tappet 8 slides up and down freely, and a spring 9 keeps it pushed up so that its upper contact area 8*a* remains in contact with the low speed cam 3. A tappet beam 10 is coupled to the other end of the direct-driven tappet 8 via a ball joint 8*b*, and the two ends of this tappet beam 10 are fitted to the stems 2*a*, 2*a'* of the port opening/-closing valves 2, and 2', rest on the valve spring retainers 12 discussed below, via the washers 11.

The piston type tappets 13, and 13' which freely up and down inside the cam carrier 6, are located directly below the high speed cams 4, 4'.

A pair of pistons 13*a*, 13*b* constitute each of the piston-type tappets 13 and 13'. An upper contact area 13*c* of the upper piston 13*a* remains in contact with the high speed cam 4 or 4', being kept pushed up by a corresponding spring 14. The lower piston 13*b* is located inside the cam carrier 6, with an oil chamber 15 separating it from the upper piston 13*a*. The lower end of the lower piston 13*b* is coupled as a single composite unit to the stem 2*a*, or 2*a'* of the port opening/closing valve 2 or 2'.

The port opening/closing valves 2, 2' are intake and exhaust valves that open and close ports 16, 16' located inside the cylinder head 7, and remain pushed up by springs 17, 17' via the valve spring retainer 12.

An oil channel 18, provided with an electromagnetic control valve 20, joins the oil chamber 15 with the lubricating circuit 10 of the engine.

This electromagnetic control valve 20 consists of a check valve 23, which is kept pressed inside a valve chamber 21 by a spring 22 located on the oil chamber 15 side of valve 23 to prevent the flow of oil to said oil chamber 15, and an electromagnetic coil mechanism 25 containing a needle 24 to push open the check valve 23 when excited. 26 is the lubricating oil pump driven by the engine and, as is well known, feeds the lubricating oil under pressure proportional to the engine speed, and 27 is the oil sump.

In the construction described above, if the cam shaft 1 rotates synchronously with the engine, the low speed cam 3 and the high speed cams 4, 4' provided on the cam shaft 1 will rotate and push their respective direct-driven tappet 8 and piston-type tappet 13. When the engine rotates at a slow speed, a signal send before hand puts the electromagnetic control valve 20 into action, and with this the needle 24 pushes the check valve 23 open, thus draining off the high pressure lubricating oil from the oil chamber 15 and the oil passage 18 back to valve chamber 21, where the pressure is relatively low at that time.

In this state the lower end of the upper piston 13*a* of the piston-type tappet 13 will just move up and down inside the oil chamber 15 under the action of the high speed cams 4 or 4' without making any contact with the lower piston 13*b*.

Consequently, the port opening/closing valves 2, 2' will be operated by the direct-driven tappet 8 via the tappet beam 10 under the action of the low speed cam 3. As a consequence, the ports 16, 16' will open and close in small amounts and for short durations according to the cam lift and timing shown by the dotted line in FIG. 3.

Under such a situation, the speed of the gas passing through the port opening/closing valves 2, 2' will increase, leading to a rise in the engine output.

When the engine reaches a predetermined high speed rotation, a signal makes the electromagnetic control valve 20 operational and the needle 24 opens the check valve 23, so that lubricating oil, whose pressure has risen at high engine speed, from the lubricating circuit 19 of the engine will be fed to the oil passage 18 and oil chamber 15 past the check valve 23. In this state, if the upper piston 13*a* of the piston-type tappet 13 or 13' is pressed down by the high speed cam 4 or 4', the lubricating oil will transmit the pressure to the lower piston 13*b* and press it down.

Figure 3:
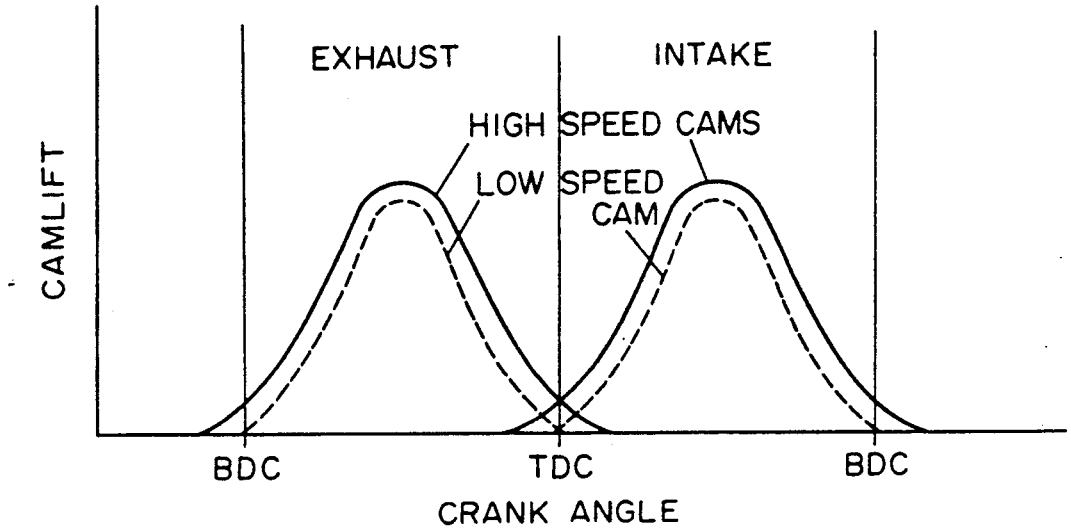
FIG. 3 is a diagram illustrating cam lift versus crank angle.
Figure 4:
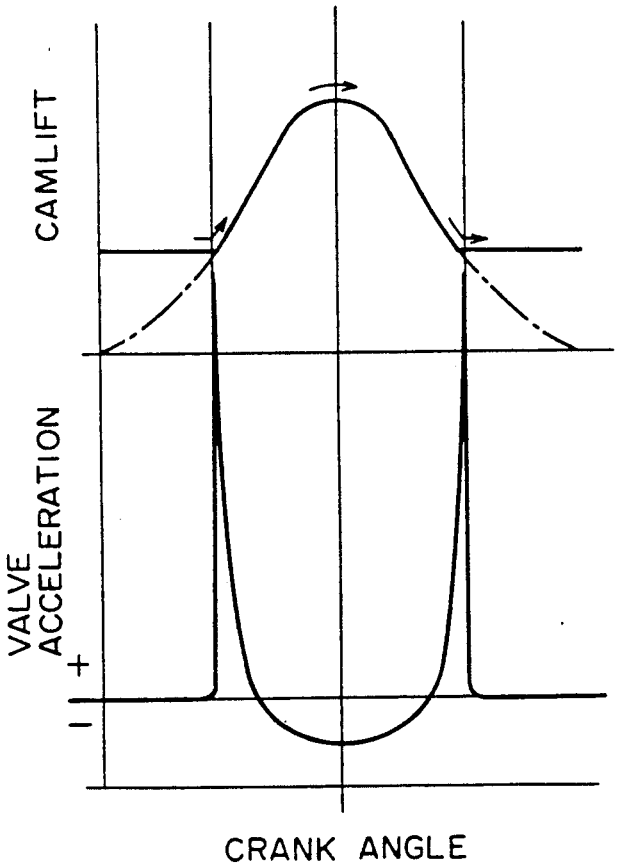
FIG. 4 is a linear diagram of cam lift and valve acceleration of a conventional variable valve timing and lift mechanism.

Consequently, the port opening/closing valves 2, 2' will open and close the ports 16, 16' in larger amounts and for longer durations according to the lift and timing of the high speed cams 4, 4' shown by the continuous line in FIG. 3.

Under such a situation, the amount of gas passing through the port opening/closing valves 2, 2' will increase, thus generating high engine output by raising the intake-exhaust efficiency. Needless to say, during the time the port opening/closing valves 2, 2' are driven by the high speed cams 4, 4', the direct-driven tappet 8 and the tappet beam 10 will also move up and down under the action of the low speed cam 3, but this movement will not cause any interference because the lift of the high speed cam 4 or 4', is much larger than the lift of the low speed cam 3.

Figure 5:
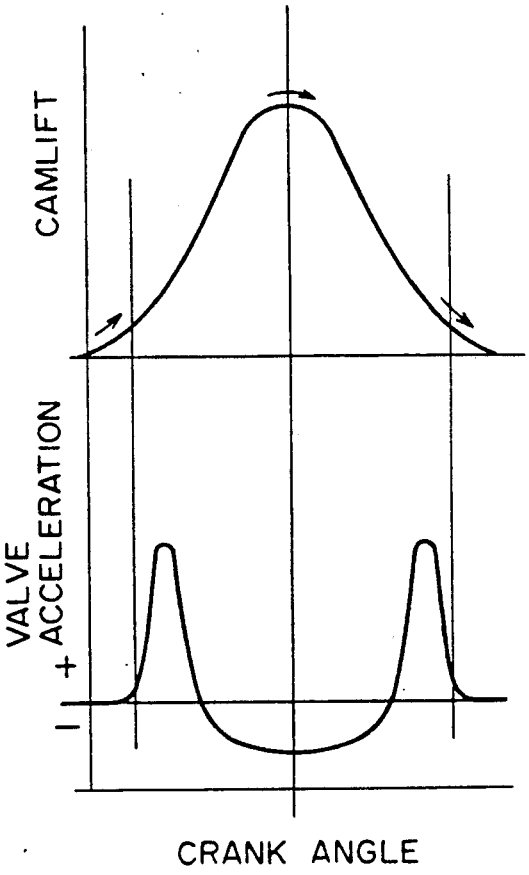
FIG. 5 is a linear diagram of cam lift and valve acceleration of the variable valve timing and lift device of this invention.

In the mechanism described above, since the cam lift and timing are varied by filling the oil chamber 15 with lubricating oil (at the time of high speed rotation) and by draining out the oil from the chamber (at the time of low speed rotation), there will be no cam lift loss. Again, since the ramp that ensures normal operation of the dynamic valve mechanism on the cam profile is also put into use during this whole operation, the acceleration of the valves at the time of opening and closing will be low and normal as shown in FIG. 5. Consequently, the noise will be low, and what is more important, the valves will not bounce at the time of opening and closing the ports.

The variable valve timing and lift mechanism of this invention described above consists of low and high speed cams provided in phase on the camshaft of an overhead camshaft engine, the high speed cam having larger lift than the low speed cam although the base circle diameter of the two is the same, the low speed cam being coupled to the port opening/closing valve(s) via a direct-driven tappet and the high speed cam also being coupled to the same valve via a piston-type tappet consisting of a pair of pistons sealed in a support with an oil chamber interposed in between. The oil chamber is connected to the lubricating oil circuit of the engine by an oil passage provided with a control valve. Because of the above construction, this variable valve timing and lift device with the so-called direct attack-type dynamic valve mechanism, where the cam drives the valve directly without using any rocker arm and connecting mechanism, has great advantages such as since it solves the problems created by the inability of the rocker arm, etc. to keep pace with the valve at high speed because of inadequate rigidity of the dynamic valve system; it yields high output at both low and high speeds; it does not suffer from lift loss as in the case of the unexamined Japanese patent publication 59-101515; it can correctly select valve timing and valve lift in conformity with the high or low speed of the engine; and it has small valve acceleration.

What is claimed is:

1. A variable valve timing and lift device with low and high speed cams provided on the camshaft of an overhead camshaft engine, the high speed cam having larger lift than the low speed cam although the base circle diameter of the two is the same, the low speed cam being coupled to at least one valve via a direct-driven tappet and the high speed cam being coupled to said at least one valve via a piston-type tappet consisting of a pair of pistons sealed in a support with an oil chamber interposed between said pistons, and the oil chamber connected to a lubricating oil circuit of the engine by an oil passage provided with a control valve.

2. A variable valve timing and lift device according to claim 1, wherein the control valve consists of a check valve, which is kept pressed inside a valve chamber by a spring located on the oil chamber side to prevent the flow of oil to said oil chamber, and an electromagnetic coil mechanism containing a needle to push open said check valve when excited.

* * * * *